US008141345B2

(12) United States Patent
Schnaibel et al.

(10) Patent No.: US 8,141,345 B2
(45) Date of Patent: Mar. 27, 2012

(54) METHOD AND DEVICE FOR REGULATING THE FUEL/AIR RATIO OF A COMBUSTION PROCESS

(75) Inventors: Eberhard Schnaibel, Hemmingen (DE); Kersten Wehmeier, Ludwigsburg (DE); Klaus Hirschmann, Schwieberdingen (DE); Richard Hotzel, Stuggart (DE)

(73) Assignee: Robert Bosch GmbH, Stuttgart (DE)

( * ) Notice: Subject to any disclaimer, the term of this patent is extended or adjusted under 35 U.S.C. 154(b) by 155 days.

(21) Appl. No.: 12/647,717

(22) Filed: Dec. 28, 2009

(65) Prior Publication Data

US 2010/0212291 A1 Aug. 26, 2010

Related U.S. Application Data

(63) Continuation of application No. 10/364,255, filed on Feb. 11, 2003, now abandoned.

(30) Foreign Application Priority Data

Feb. 13, 2002 (DE) ..... 102 05 817

(51) Int. Cl.
*F01N 3/00* (2006.01)

(52) U.S. Cl. ..... 60/285; 60/274; 60/286; 60/295; 60/301; 701/103; 701/109

(58) Field of Classification Search ..... 60/274, 60/276, 285; 701/103, 109
See application file for complete search history.

(56) References Cited

U.S. PATENT DOCUMENTS 4,779,414 A 10/1988 Nagai et al.
5,077,970 A * 1/1992 Hamburg ..... 60/274
5,255,512 A * 10/1993 Hamburg et al. ..... 60/274
5,359,852 A * 11/1994 Curran et al. ..... 60/274
5,491,975 A 2/1996 Yamashita et al.
5,661,972 A 9/1997 Katoh et al.
5,842,340 A 12/1998 Bush et al.

(Continued)

FOREIGN PATENT DOCUMENTS

DE 40 01 616 7/1991

(Continued)

OTHER PUBLICATIONS

Kraftfahrttechnisches Taschenbuch, 22nd Edition, VDI Publishers Dusseldorf, ISBN 3-18-419122-2 (Automotive Handbook 4th Edition, SAE Society of Automotive Engineers, USA ISBN 1-56091-918-3.

(Continued)

*Primary Examiner* — Thomas Denion
*Assistant Examiner* — Jesse Bogue
(74) *Attorney, Agent, or Firm* — Kenyon & Kenyon LLP

(57) ABSTRACT

A method for regulating the fuel/air ratio of a combustion process which is operated alternatingly with excess air and air deficiency, and having at least one catalyst volume in the exhaust gas of the combustion process which stores oxygen when there is excess oxygen in the exhaust gas and gives it off when there is oxygen deficiency, in which method the oxygen charges into the catalyst volume taking place when there is excess air, and the oxygen discharges from the catalyst volume taking place when there is air deficiency determined, and in which the fuel/air ratio is regulated in a first control loop such that the sum of the oxygen charges and oxygen discharges determined in a predefined interval takes on a predetermined value, wherein the combustion process is operated using oxygen excess or oxygen deficiency, respectively, at least until these appear at an oxygen-sensitive Nernst probe downstream from the catalyst volume.

18 Claims, 5 Drawing Sheets

U.S. PATENT DOCUMENTS

| | | | | |
|---|---|---|---|---|
| 5,901,552 | A | 5/1999 | Schnaibel et al. | |
| 6,226,982 | B1 | 5/2001 | Poggio et al. | |
| 6,244,045 | B1 | 6/2001 | Purvis | |
| 6,253,542 | B1 * | 7/2001 | Omara et al. | 60/274 |
| 6,311,482 | B1 | 11/2001 | Yamashita | |
| 6,546,719 | B2 | 4/2003 | Kamoto et al. | |
| 6,718,754 | B2 * | 4/2004 | Kobayashi et al. | 60/277 |
| 6,782,695 | B2 * | 8/2004 | Lutz et al. | 60/285 |
| 7,059,120 | B2 * | 6/2006 | Nakagawa et al. | 60/289 |
| 7,100,364 | B2 * | 9/2006 | Harrison et al. | 60/285 |
| 2004/0006973 | A1 * | 1/2004 | Makki et al. | 60/285 |
| 2006/0123769 | A1 * | 6/2006 | Odendall | 60/285 |

FOREIGN PATENT DOCUMENTS

| | | |
|---|---|---|
| DE | 43 22 344 | 1/1994 |
| WO | 01/61165 | 8/2001 |

OTHER PUBLICATIONS

Research Disclosure "A method for estimating and controlling the oxidation state of a catalytic converter," May 1998, p. 549, Mason Publications, Hampshire, Great Britain, XP000824684.

* cited by examiner

METHOD AND DEVICE FOR REGULATING THE FUEL/AIR RATIO OF A COMBUSTION PROCESS

CROSS-REFERENCE TO RELATED APPLICATIONS

The present application is a continuation of U.S. patent application Ser. No. 10/364,255 filed on Feb. 11, 2003 now abandoned, and which claims priority to German Patent Application No. 102 05 817.2 filed on Feb. 13, 2002, all of which are hereby incorporated by reference in their entirety.

FIELD OF THE INVENTION

The present invention relates to a method for regulating the fuel/air ratio of a combustion process which is operated alternatingly with excess air and air deficiency, having at least one catalyst volume in the exhaust gas of the combustion process which stores oxygen when there is excess oxygen in the exhaust gas and gives it off when there is oxygen deficiency, in which method the oxygen charges take place into the catalyst volume when there is excess air, and the oxygen discharges take place from the catalyst volume when there is a determined air deficiency, and in which the fuel/air ratio is regulated such that the sum of the oxygen charges and oxygen discharges determined in a predefined interval takes on a predetermined value. The present invention furthermore relates to an electronic control device for performing the method.

In general, the present invention relates to the regulation of the fuel/air ratio or the air ratio lambda of a combustion process.

BACKGROUND INFORMATION

A method and a device for regulating the fuel/air ratio of a combustion process are described in German Published Patent Application No. 40 01 616.

Lambda gives the ratio of the actual air quantity participating in the combustion process to the air quantity which is required for a stoichiometric combustion of a certain fuel quantity. Exhaust gases of combustion processes are frequently passed through a catalytic converter in order to convert exhaust gas components such as nitrogen oxides (NOx), unburnt hydrocarbons (HC) and carbon monoxide (CO) to nitrogen, water and carbon dioxide. For instance, three-way catalysts are used for cleaning exhaust gas in motor vehicles.

An optimum efficiency of the conversion, which is characterized in response to specified charges of NOx, HC and CO in the catalytic converter by a minimum of NOx, HC and CO after the catalytic converter, requires a precise setting of a desired fuel/air ratio for the combustion process. This may also include the most precise possible setting of a desired behavior over time, such as periodic fluctuation of lambda about an average setpoint value.

With regard to the optimized conversion of catalytic conversion systems in motor vehicles, conventionally an exhaust gas probe downstream from the catalytic converter ensures the converter's optimum operation with respect to pollutants. Nernst probes are primarily used for this purpose. A Nernst probe is understood to be an oxygen-sensitive exhaust gas sensor, which has a characteristic curve, plotted against the mixture composition that is in thermodynamic equilibrium within the range of the stoichiometric mixture composition, which has a steep transition between a low (approximately 100 mV) and a high (approximately 900 mV) signal level.

Conventional methods may be summarized by a generic term two-step control. The concept of two-step control includes a regulation in which the actual value of the probe signal, which corresponds to an actual oxygen concentration in the exhaust gas, and thus to an actual lambda value, is compared to a setpoint value, and at which value, depending on the sign of the deviation, an enrichment or a leaning of the fuel/air ratio is generated. This regulation is distinguished by the fact that only the sign but not the absolute value is processed by a regulating algorithm.

Conceptually, two-step controls, and this applies to two-step control probes, are used upstream and downstream from a catalytic converter. These methods have in common that they react to the above-mentioned steep transition of the probe signal by an abrupt change in the control variable, such as an injection pulse width. The abrupt advance is followed by an approximately static change in the control variable, which as a pattern over time that corresponds to a ramp (i.e., it is linear). The lambda value of the optimum pollutant conversion in the catalytic converter does not correspond exactly to the lambda value of the steep change in the Nernst probe signal. In order nevertheless to be able to set the optimum value for the catalytic converter, using the Nernst probe, depending on the direction of the sign change, one may use a different and thus non-symmetrical step change height, a ramp following a step change and non-symmetrical with respect to the step change direction, or a predetermined delay time between a probe signal change and a control variable change. Thereby the average value of the pattern over time of the control variable is shifted such that the catalytic converter is operated at an optimum operating point. This lies mostly somewhat on the rich operation side, since, performing in this manner, one avoids, in particular, a safety distance from the lean operation side, which is more critical with regard to undesired NOx emissions. This manner of two-step regulation is frequently performed on a basis of a signal of an exhaust gas probe situated upstream from the catalytic converter. The oscillation in the oxygen content of the exhaust gas occurring during a step-change ramp regulation is averaged by the catalytic converter, provided it is functional. This averaging occurs because the catalytic converter, during the half wave of the oscillation during excess oxygen, stores the excess oxygen from the exhaust gas, and gives off the stored oxygen during the half wave of the oscillation having the lack of oxygen. An exhaust gas probe situated downstream from the (sufficiently large) catalytic converter in this case registers the average value of the oscillation. Since the preconnected catalytic converter protects the downstream probe from excessive temperature fluctuations, and also promotes the setting of the thermodynamic equilibrium of the exhaust components, the signal of the downstream probe is less influenced by temperature influences and cross sensitivities of the exhaust gas probe. In this context, cross sensitivity is understood to mean an undesired shifting of the probe characteristic curve plotted against the oxygen content in the exhaust gas in the presence of other exhaust gas components. Therefore, the downstream probe measures more accurately and may be used to guide the upstream probe. If, for example, the upstream probe regulates to an incorrect setpoint value because of the shifting of a characteristic curve, this is recognized via the signal of the downstream exhaust gas probe, and the setpoint value for the regulating circuit of the upstream probe is appropriately corrected.

Also conventional are so-called stepless methods. These do not utilize the steep change of a Nernst probe signal, but rather the comparatively linear pattern of the pump current as a function of the lambda value in the case of a wide range lambda probe. These methods use not only the sign, but also the absolute value of the deviation of an actual value from a setpoint value. Here too, one should observe that the catalytic converter is operated using a slightly rich mixture. Since smaller probe signal changes are used in these methods, the cross sensitivities, temperature sensitivities and aging deterioration-specific shifting of pollutant dependencies have a comparatively strong effect.

A further group of methods is based on an optimized filling strategy of the catalytic converter. The methods of this group strike a balance of the charged components and attempt to adjust a faulty balance before it is to be measured by the probe situated downstream from a certain catalyst volume. The Nernst probe is operated in the rich branch of its curve, and just equalizes a false balance zero point. German Published Patent Application No. 40 01 616 illustrates such a method for regulating the fuel/air ratio of a combustion process which is alternatingly operated with excess air and deficiency of air. A catalyst volume in the exhaust gas of the combustion process stores oxygen during excess of oxygen in the exhaust gas, and releases it again during oxygen deficiency. In this method the oxygen charge taking place into the catalyst volume during an excess of air, and the oxygen discharges from the catalyst volume during air deficiency are determined with the aid of a Nernst probe situated upstream from the catalytic converter, and the fuel/air ratio is regulated such that the sum of the oxygen charges and the oxygen discharges during a predetermined interval takes on a predetermined value.

It has been shown that future legal requirements, such as the SULEV requirements (super ultra low emission vehicle) in the United States of America will require further improvements of regulating strategies, with regard to optimized catalytic converter operation in conjunction with further increased robustness and regulating speed.

This requirement may be fulfilled by the method described in German Published Patent Application No. 40 01 616 on the basis that the combustion process is operated respectively at least as long at excess oxygen or oxygen deficiency until it appears at an oxygen-sensitive Nernst probe downstream from the catalyst volume. In a modification of the method, in one exemplary embodiment of the present invention, no exhaust gas probe is required upstream from the catalytic converter. In a further exemplary embodiment, a wide range lambda probe is used upstream from the catalytic converter, instead of the Nernst probe.

SUMMARY

The method according to the present invention makes possible the required optimized catalytic converter operation, and, in this context, also may improve on the above-mentioned methods with regard to robustness and regulating speed in operating points in which the above methods have insufficient robustness and in which these methods are impaired by cross sensitivities. This improvement occurs because the present invention includes partial aspects of the above-described methods, and supplements them by portions which effect a substantial increase in the robustness.

The present invention uses the two-step characteristics of a Nernst probe downstream from the catalytic converter in conjunction with a balancing, i.e., consideration of oxygen charges and oxygen discharges with respect to the catalytic converter.

Based on the conservation of mass, these charges and discharges may have to be equal in the case of the mixture control according to the present invention. If this method were to be applied in its simplest form, and ignoring nonlinearities, a step change probe voltage of, for example, 450 mV may appear downstream from a catalyst volume connected to the step change probe (but, on account of nonsymmetries, a voltage deviating from 450 mV may also occur).

In order to ensure optimized operation, a controlling part was added to the regulating part. This part is based on an optimum balance for the operation of the catalytic converter. Because of the necessary optimization of the balance, an additional quantity is determined that is necessary with respect to the zero point balance. With respect to the zero point balance, a controlled proportion of rich or lean is appended to the sides rich-lean or lean-rich of the step change probe. This proportion may be measured such that, downstream from the overall catalytic converter system, a pollutant optimum discharge occurs.

Thus, a further aspect of the present invention provides that the change between oxygen excess and oxygen deficiency during operation of the internal combustion machine is controlled such that the difference in the oxygen charges into the catalyst volume during excess air, and the oxygen discharges from the catalyst volume during air deficiency takes on a predetermined value.

Another example embodiment of the present invention provides that, for the determination of the oxygen charges into the catalyst volume taking place during air excess and oxygen discharges from the catalyst volume during air deficiency, a variable is used which at least co-determines the fuel inflow to the internal combustion engine.

According to an example embodiment of the present invention, the variable named is formed based on an intake air quantity calculated from measured variables and based on a fuel quantity metered into this air intake quantity.

According to an example embodiment of the present invention, the variable named is formed as a function of the signal of an exhaust gas probe situated upstream from the catalyst volume.

Still another example embodiment of the present invention provides that the variable named is an input variable for a second control loop in which the fuel/air ratio is regulated using a time constant that is smaller in comparison with the first control loop.

Yet another example embodiment of the present invention provides that the formation of the variable named is changed when the oxygen charges and the oxygen discharges deviate from each other.

According to a further aspect of this example embodiment of the present invention, the change may occur so that the named deviation becomes smaller.

According to an example embodiment of the present invention, the change may be developed as a function of the integral of the deviation named.

According to an example embodiment of the present invention, the fuel/air ratio may be predefined by a superordinated control loop.

A further example embodiment of the present invention provides that the value of the oxygen charges and the oxygen discharges determined are used to determine a real zero value between the oxygen excess and the oxygen deficit.

In another example embodiment of the present invention, the present invention may also be understood as a method for regulating the fuel/air ratio of a combustion process having a lambda probe downstream from a partial catalyst volume, in which the lambda probe indicates when the degree of filling of the partial catalyst volume with oxygen exceeds a first predefined value or undershoots a second predetermined value. Upon the undershooting of the second predefined value, the fuel/air ratio is set definitely leaner on average (poorer as to fuel). Upon the exceeding of the second predefined value resulting therefrom, a definite enrichment on the average takes place. In this context, a characteristic frequency of the leaning and the enrichment occurs for the operating point of the combustion process and the catalytic converter. In an internal combustion engine, an operating point is defined, for instance, by a certain value of combustion chamber filling at a specific rotational speed. Furthermore, oxygen charge and oxygen discharge are balances. Fuel dosing occurs such that, as the balance of the oxygen charges and the oxygen discharges, on the average over one period (one oxygen charge and one oxygen discharge), a predetermined value, such as a zero value, occurs, which corresponds to a specific average lambda value. By a specified delay in the change between a rich and a lean fuel/air mixture on the average, an optional average lambda value may be set, since each delay has the effect of an additional charge of oxygen (in response to a delayed change to a rich mixture) or a discharge of oxygen when there is delayed change to a lean mixture). The specified delay may take place so that the resulting additional charge or the additional discharge per one period corresponds to the predetermined value. The present invention also relates to a control device, such as an electronic control device for performing at least one of the methods, further refinements and example embodiments.

DETAILED DESCRIPTION

Figure 1:
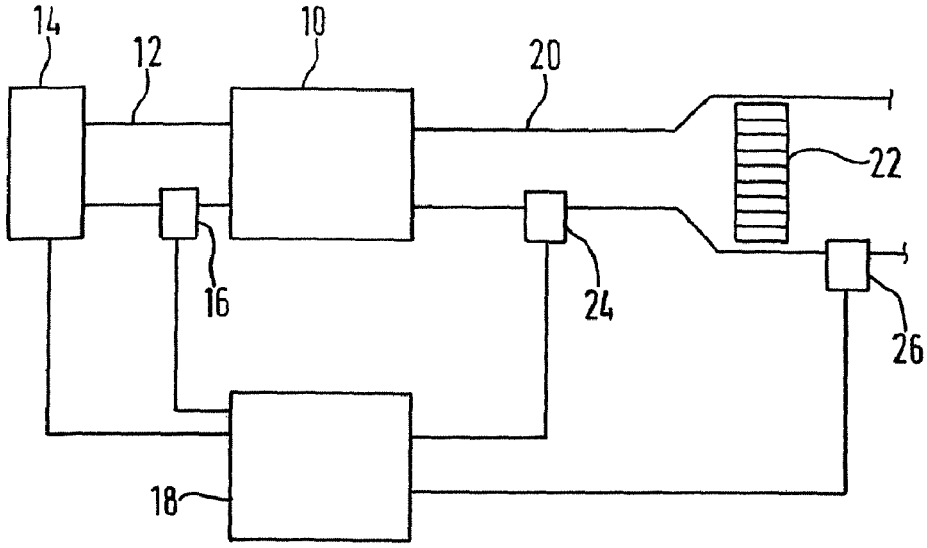
FIG. 1 is a schematic view of a structure of a first technical environment in which the present invention provides its effect.

In FIG. 1, element 10 refers an internal combustion engine which is combusting a mixture of fuel and air in a combustion process. The quantity or mass of air flowing to the combustion process is recorded by an air quantity measuring instrument 14. The signal of air quantity measuring instrument 14 is conducted to an electronic control unit 18. Electronic control unit 18 calculates a fuel metering signal from this and possibly from further operating characteristic values of the combustion process, using which a fuel metering arrangement 16 is controlled. In FIG. 1, fuel metering arrangement 16, such as an injection valve, or a system of injection valves, is situated in a suction manifold 12 of the internal combustion engine. In this case, the formation of the mixture, i.e., the mixing of aspirated air and metered-in fuel occurs in the suction manifold. Alternatively, the mixture formation may also occur directly in the combustion chambers of the internal combustion engine, as in a Diesel engine and an Otto engine having direct fuel injection. The exhaust gases of the combustion process in the internal combustion engine are passed through an exhaust pipe 20 to a catalyst volume 22. An exhaust gas probe 24 positioned upstream from catalyst volume 22 may record the oxygen concentration in the exhaust gas, between the combustion process and catalyst volume 22. Further on, exhaust gas probe 24 is also referred to as precatalyst probe 24. An additional exhaust gas probe is positioned downstream from catalyst volume 22. This exhaust probe may be implemented as a so-called Nernst probe 26, while precatalyst probe 24 may be implemented as a wide range lambda probe. An exemplary embodiment of a Nernst probe 26 is described on page 491 (491) of the Kraftfahrttechnisches Taschenbuch, 22nd Edition, VDI Publishers Düsseldorf, ISBN 3-18-419122-2 (Automotive Handbook 4th Edition, SAE Society of Automotive Engineers, USA, ISBN 1-56091-918-3). A wide range lambda probe as an exemplary embodiment of precatalyst probe 24 is also described in the same reference. Wide range lambda probe 24 has a measuring gap which is connected to the exhaust gas via a gas intake orifice. Furthermore, the measuring gap has an electrochemical pump cell by which oxygen may be pumped from or into the measuring gap. An electronic circuit regulates the voltage present at the pump cell such that the composition of the gas in the measuring gap is constant at lambda=1. Pump current Isvk required for this supplies a measure for the oxygen content of the exhaust gas. The wide range lambda probe supplies a current signal I Precatalyst Probe. Nernst probe 26 supplies a voltage signal U Probe Postcatalyst. The signals of the two exhaust gas probes 24 and 26 are conducted to electronics control device 18, and supplementingly influence the fuel metering. Internal combustion engine 10, to an extent, represents a controlled system as component of a first control loop made up of internal combustion engine 10, exhaust gas probe 24, electronic control device 18 and fuel metering device 16. An oxygen deficit in the exhaust gas is registered by exhaust gas probe 24, and, by appropriate processing by a regulating algorithm in electronic control device 18, it leads to an increase in the injection impulse width by which fuel metering arrangement 16 is driven. A further control loop is superposed on this control loop, and is based on the signal of Nernst probe 26. The interaction of the two control loops, according to the present invention, is explained below with regard to the structure of FIG. 2. Broken line 27 in FIG. 2 separates the functional structure of the electronic control unit, according to the present invention, denoted as 18 from the remaining components of the structure of FIG. 1, in particular from internal combustion engine 10, precatalyst probe 24, catalyst volume 22 and Nernst probe 26. Number 28 denotes a characteristics map which is addressed, for example, by input values such as the measured air quantity and the rotational speed of the internal combustion engine and which supplies a base impulse width t_base as output value for the fuel metering. This output value is linked in regulating linkage 30 with a regulating factor fr from a first controller 34. The result of this linkage determines as injection impulse width ti the fuel quantity supplied to the combustion process in internal combustion engine 10. From the combustion process there results a specific oxygen concentration in the exhaust gas, which is reflected in signal Ushk of Nernst probe 26. This signal Ushk of Nernst probe 26 is supplied to a two-step controller 36. This two-step controller 36 represents a genuine two-step controller, in which the control variable is only able to correspond to one of two variables respectively. In the case of controller 36, signal Ushk of exhaust gas probe 26 is compared to a threshold value such as 450 millivolt. If an excess of oxygen exists downstream from catalytic converter 22, signal Ushk has an order of magnitude of approximately 100 millivolt as an example. In this case two-step controller 36 enriches by, for instance, issuing a factor 1.02, by which the control variable formed in the first controller is increased by multiplying, which ultimately leads to an increase in the injection pulse width, and thus to an enrichment of the mixture. If, on the other hand, there is a deficiency of oxygen downstream from catalyst volume 22, signal Ushk has an order of magnitude of ca 900 millivolt and two-step controller 36 leans off correspondingly, by, for instance, issuing a factor 0.98. This factor 0.98 reduces control variable fr in first controller 34, which ultimately leads to a shortening of the injection impulse widths ti, and thus to a leaning. Nernst probe 26 thereby forms a second control loop in conjunction with two-step controller 36 and the remainder of the control system (34, 30, 10, 24, 22). This second control loop makes sure that catalyst volume 22 is filled with a mixture that is lean on average if the probe downstream from catalyst volume 22 indicates an oxygen deficiency. This lean mixture makes sure that Nernst probe 26, downstream from catalyst volume 22 will at some time indicate an oxygen excess. When this occurs, catalyst volume 22 is subsequently filled with a mixture that is rich on average (oxygen deficiency=charge of reduction means), and the signal of Nernst probe 26 jumps back again to 900 millivolt at some time.

Figure 2:
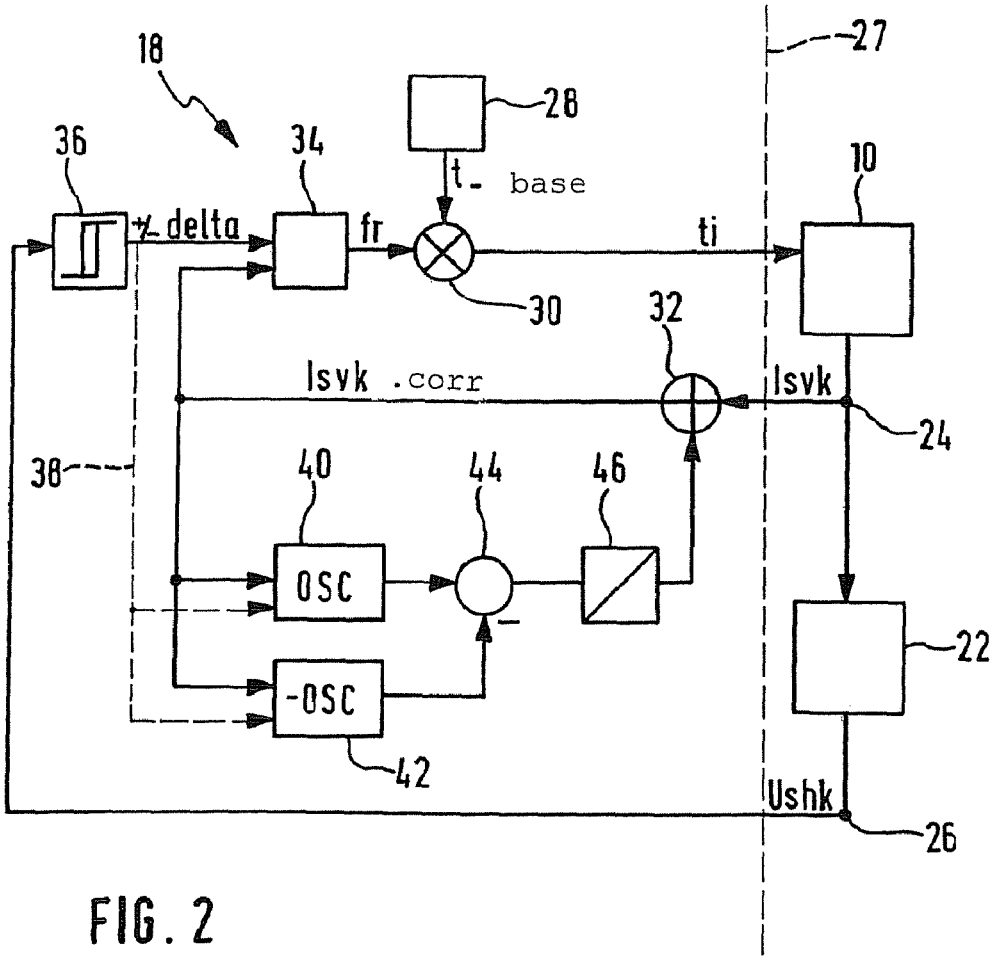
FIG. 2 is a schematic block diagram of an exemplary embodiment according to the present invention.

In that manner the two-step control algorithm fills and empties catalyst volume 22 again and again. Since the oxygen storage may only give off the quantity of oxygen which it had stored before, the real oxygen excess and deficiency quantities must be equal. In other words: the oxygen charged into catalyst volume 22 during the oxygen excess phases corresponds in its quantity to the oxygen discharged from catalyst volume 22 during oxygen deficiency. According to the present invention, these two quantities, equal by definition, are recorded by measuring technology and used for correcting the first control loop. For this purpose, FIG. 2 illustrates the structure 38, 40, 42, 44, 46 and 32. In this context, the number 38 denotes a trigger signal path, by which a signal integrator 40 is set to zero and triggered. In parallel with trigger signal 38, signal integrator 40 is supplied with signal Isvk of precatalyst probe 24, or rather a corrected signal Isvk_Corr of precatalyst probe 24. This signal integrator is configured so that it only integrates the oxygen excess portion of signal Ivsk. The integration is triggered when two-step controller 36 provides a leaning signal, and is stopped when two-step controller 36 switches over to enriching mixture. The final value of oxygen storage integrator 40 thus supplies a measure of the oxygen storage capability of the catalytic converter (oxygen storage capacity OSC). Analogously, integrator 42 calculates a negative oxygen deficiency during oxygen deficiency phases, i.e., an oxygen discharge, –OSC.

Figure 3:
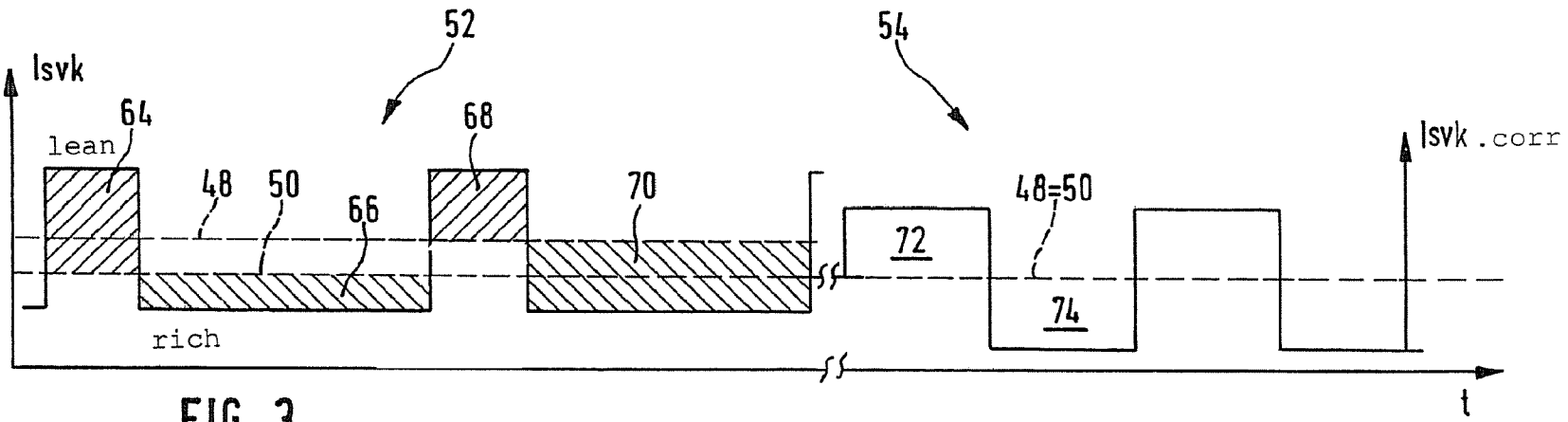
FIGS. 3 and 4 are signal patterns corresponding to the exemplary embodiment of the present invention illustrated in FIG. 2.
Figure 4:
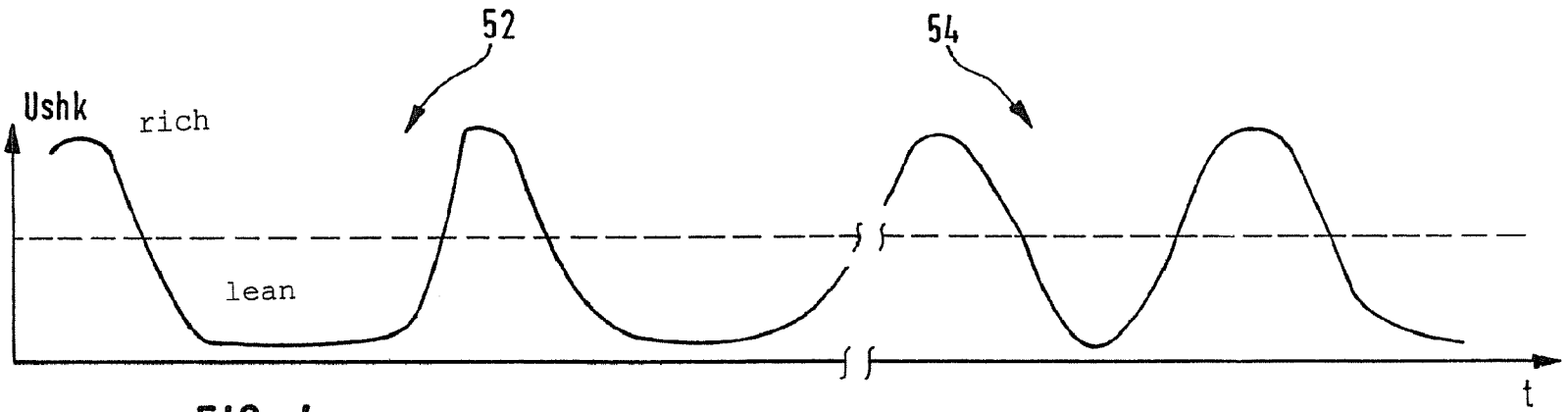

In difference linkage 44 the output signals of integrators 40 and 42 are subtracted from each other. Since they are physically equal by definition, a result of difference linkage 44 that differs from zero indicates an error in the calculation. Within the framework of the present invention, it is assumed that such a calculating error is based on a characteristic curve shift of signal Isvk of precatalyst probe 24. A shift in the characteristic curve has the result, for example, that it is already signaling a rich mixture, in spite of the fact that actually a lean mixture is still present. As a result, the value of MINUS_OSC integrator 42 will be greater than the value of OSC integrator 40. The difference between the two values is supplied to an integrator 46, which has an output signal that corrects the signal Isvk of precatalyst probe 24 via an offset correction linkage 32. The shifted characteristic curve is thereby compensated for, to a certain extent, so that the values of OSC integrator 40 and of MINUS_OSC integrator 42 are the same again after the transient effect of the correction. These relationships are further clarified by FIG. 3 in conjunction with FIG. 4. The number 52 in FIG. 3 denotes a first time span in which the offset correction has not yet taken effect. By contrast, the number 54 in FIG. 3 denotes a second time span in which the offset correction has taken effect. All in all, FIG. 3 illustrates the temporal pattern of signal Isvk over time t. Broken line 48 marks the (wrong) measuring zero value of precatalyst probe 24. The zero value, i.e., the value separating oxygen excess from oxygen deficiency, is of fundamental meaning for the formation of the OSC and MINUS OSC quantities mentioned. This "zero value" between oxygen excess and oxygen deficiency is supplied by a probe upstream from the catalytic converter, or a stored value is used, such as an injection time, in which a stoichiometric mixture composition is assumed. However, this zero value may be faulty. According to the present invention, the oxygen excess quantity and the oxygen deficiency quantity are determined respectively with reference to this possibly erroneous zero value. The relative deviation from the assumed zero value is known. Using the measured air quantity, the absolute value of the oxygen charge and the oxygen discharge may be determined. Since the oxygen storage may only give off the quantity of oxygen which it had stored before, the real oxygen excess and deficiency quantities must be equal. If the calculated quantities are not equal, this may only be caused by the fact that the assumed zero value does not correspond to the real zero value, so that, for example, in the calculation a real charge was rated as a discharge. After that, the assumed zero value is changed, namely in the direction of the greater quantity. That means that, if in the previous calculation the oxygen excess quantity was greater than the oxygen deficiency quantity, the zero value is shifted in the direction of the oxygen excess. Starting with this new zero value, enrichment and enleanment may occur again using equal quantities. This procedure is repeated until the calculated quantities mentioned are equal. The associated zero value (then) corresponds to the real zero value. The value of the oxygen charges and oxygen discharges determined are used to determine a real zero value between the oxygen excess and the oxygen deficit. Thereby either an upstream probe or a precontrolled zero value may be corrected. This procedure is further explained while making continued reference to FIG. 3. Broken line 50 denotes the real zero value. In the wide range lambda probe the low signal level corresponds to a rich mixture, that is, oxygen deficiency, and the high signal level corresponds to a lean mixture, that is, oxygen excess. Hatched area 64 represents the integral of an oxygen excess period over the real zero value 50. Hatched area 66 correspondingly represents the integral of an oxygen deficiency period as a function of the real zero value 50. The areas are equal, because the switchover between rich and lean mixtures is made by the accurately measuring Nernst probe 26 downstream from catalyst volume 22. Hatched area 68 corresponds to the integral over the (wrong) measuring zero value of exhaust gas probe 24 during an oxygen excess period, and area 70 corresponds to the integral of an oxygen deficiency over the false measuring zero value during an oxygen deficiency period. Areas 68 and 70 are recorded by measuring technology by integrators 40 and 42 respectively. It may clearly be seen that, in the non-steady-state condition, OSC value 68 deviates a great deal from MINUS OSCvalue 70. Second time span 54, illustrates the steady state condition. As a result of the integration in block 46 and the intervention in offset correction linkage 32, signal Isvk is shifted downwards such that measuring zero line 48 coincides with real zero line 50. Thus, the signal in second time span 54 mirrors the pattern of correcting signal Isvk_corr. As can be seen in the drawing, in this case the OSC quantities 72 and the MINUS OSC quantities 74 are equal. FIG. 4 illustrates signal Ushk of Nernst probe 26 corresponding to the signal pattern in FIG. 3. Signal Isvk indicates the oxygen concentration upstream from the catalytic converter, and signal Ushk, indicates the oxygen concentration downstream from the catalytic converter. From the comparison of FIG. 3 and FIG. 4 it may be seen that, upstream from the catalytic converter oxygen excess (lean mixture) is generated as long as downstream exhaust gas probe 26 registers oxygen deficiency. In an opposite manner, upstream from the catalytic converter, oxygen deficiency (rich mixture) is generated as long as exhaust gas probe 26 situated downstream from the catalytic converter signals a lean mixture. The downstream exhaust gas probe on principle measures the transition from rich to lean mixture very accurately, since there it has the steep signal level change from 900 to 100 millivolt as an example. It also measures very accurately because preconnected catalytic converter 22 protects exhaust gas probe 26 from larger temperature fluctuations and also brings the exhaust gas components into thermodynamic equilibrium.

A balancing overall system is involved which is supported or rather calibrated by the step change of the lambda probe downstream from a partial catalyst volume. With respect to the two-step control, on account of symmetry considerations and also aspects of robustness, it is evaluated after the course of one period (possibly also after a half period), which quantity of $O_2$ was charged into, and discharged from the catalytic converter. Because of the balance, the areas may be equal. If an imbalance occurs, the offset (of the probe's characteristic curve) upstream from the catalytic converter is reset such that the balance is reestablished. If, on account of gas flowing times, a delayed system reaction occurs, because of the step change of the probe, this portion may likewise be given consideration in the balancing. If in this method a step change-shaped error results, which is greater than the amplitude fluctuation of the oxygen concentration, the regulation will no longer be able to function. That is why a decision is made according to a maximum criterion, namely that a critical time has been exceeded, and thereupon the offset adjusts for such a length of time until a probe step change occurs again.

Figure 5:
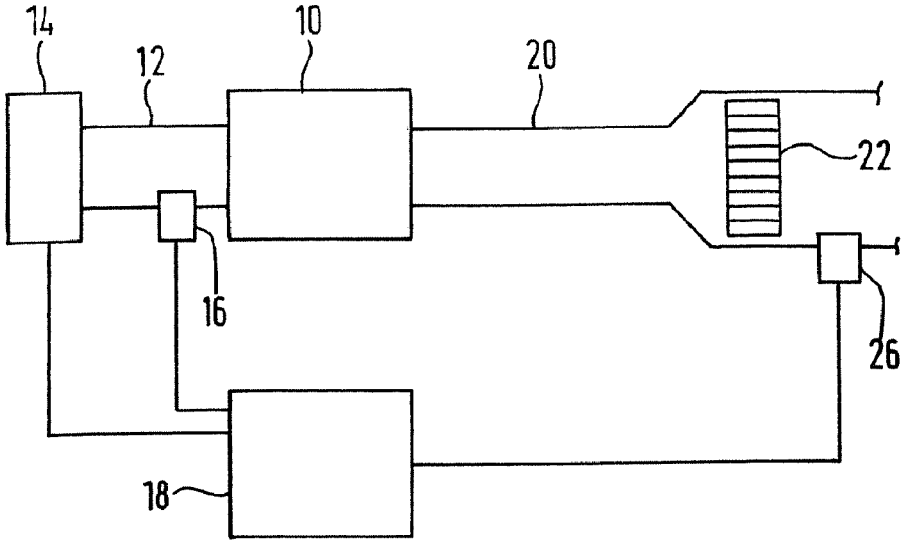
FIG. 5 is a schematic view of a structure of a second technical environment in which the present invention may be used.
Figure 6:
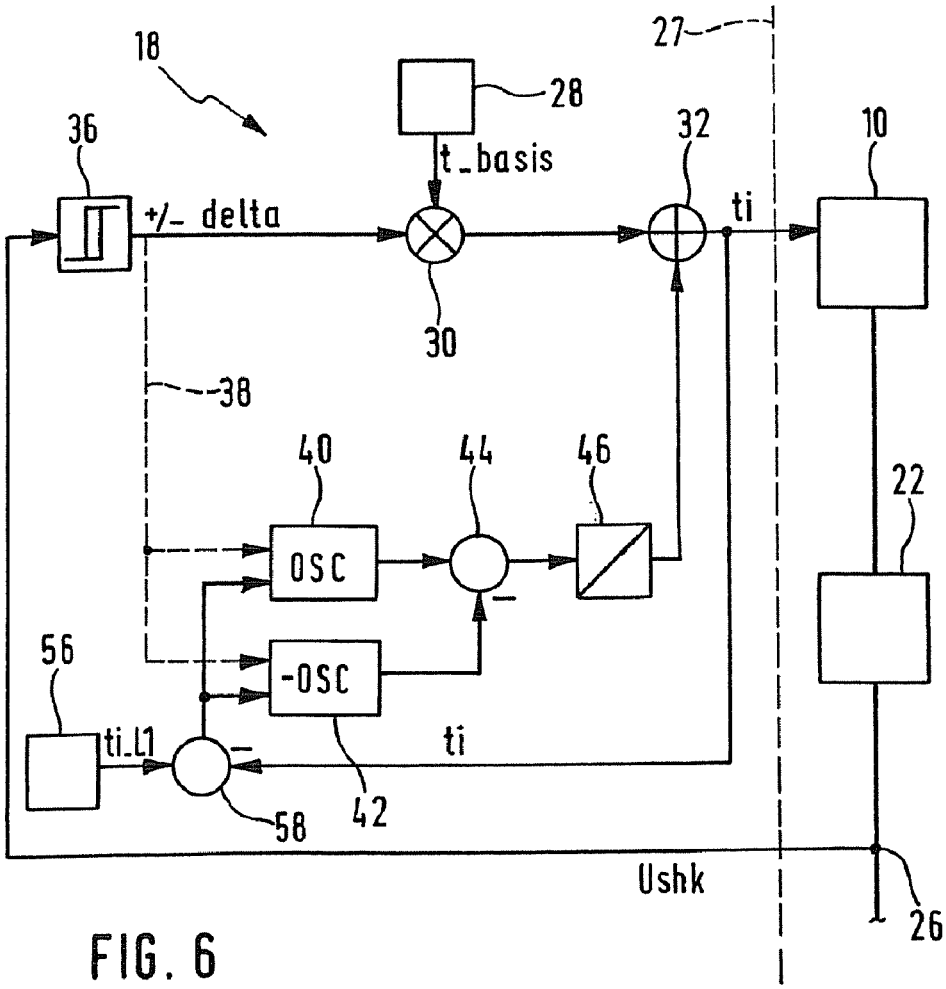
FIG. 6 is schematic view of an exemplary embodiment of the present invention.

FIG. 5 illustrates a modification of the structure in FIG. 1. In contrast to FIG. 1, no precatalyst probe 24 is provided in the structure as in FIG. 5. The structure in FIG. 6 describes an exemplary embodiment of the present invention having no precatalyst probe 24. Once again, injection impulse widths ti determine the fuel quantity which is metered into internal combustion engine 10 to match the measured air quantity. Nernst probe 26, which is situated downstream from catalyst volume 22, again supplies the voltage signal Ushk to two-step control 36. Two-step control 36 modulates base impulse widths t_base supplied by a multiplicative linkage 30 from a precontrol characteristics map 28. These base impulse widths are lengthened, for instance, by issuing an enriching factor 1.02 when there is a lean mixture downstream from catalyst volume 22. Analogously, when there is an oxygen deficiency downstream from catalyst volume 22, the control leans off by issuing a factor 0.98. Injection impulse widths ti are also supplied to a difference linkage 58, to which additionally comparison impulse widths ti L1 are supplied. The ti L1 values represent, as it were, assumed zero values in the sense that, when ti>ti L1 a rich mixture is assumed, and when ti L1>ti, a lean mixture is assumed. Analogously to the explanation in FIG. 2, here too integrator 40 supplies a measure of oxygen storability of the catalyst volume, and integrator 42 supplies a measure for the reduction arrangement storability of the catalytic converter. Here too, the difference between the two values is formed in difference linkage 44 and integrated in integrator 46. The integrator output affects the injection times via offset correction linkage 32. The operating mode of the structure according to FIGS. 5 and 6 thus corresponds largely to the operating mode of the structures as in FIGS. 1 and 2. FIG. 3 applies also to FIGS. 5 and 6. With this in mind, value Isvk would be replaced by injection time ti in FIG. 3. Then zero line 48 corresponds to a value ti L1, in the case of FIG. 6. If this value ti L1 does not supply the real lambda value, the relationships occur as illustrated in first time span 52 of FIG. 3. When the correction takes effect, the relationships illustrated in second time span 54 occurs. In other words: by the use of the offset correction, injection times ti may be uniformly shortened to the point where the desired symmetrical oscillation about the real lambda=1 value occurs. The structure of FIGS. 5 and 6 may provide, compared to the structure of FIGS. 1 and 2, that a precatalyst probe 24 may be saved.

Figure 7:
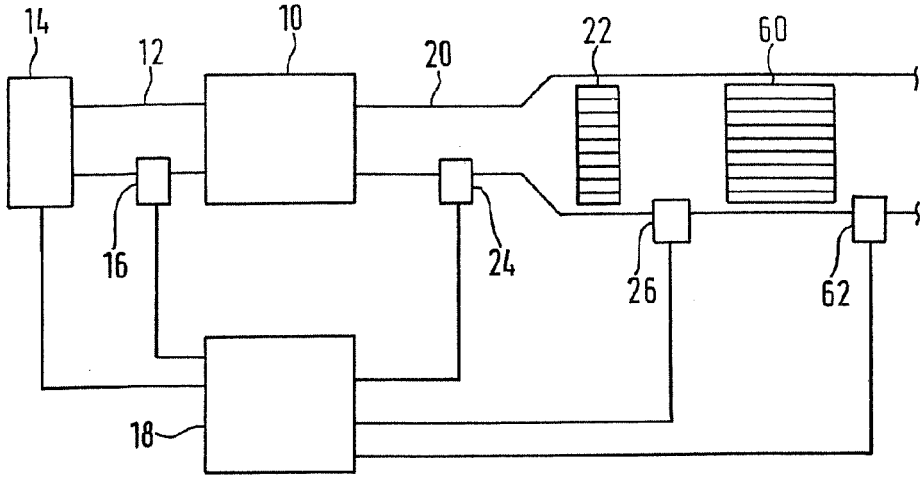
FIG. 7 is a schematic view of a structure of a technical environment of the present invention for fulfilling SULEV requirements.
Figure 8:
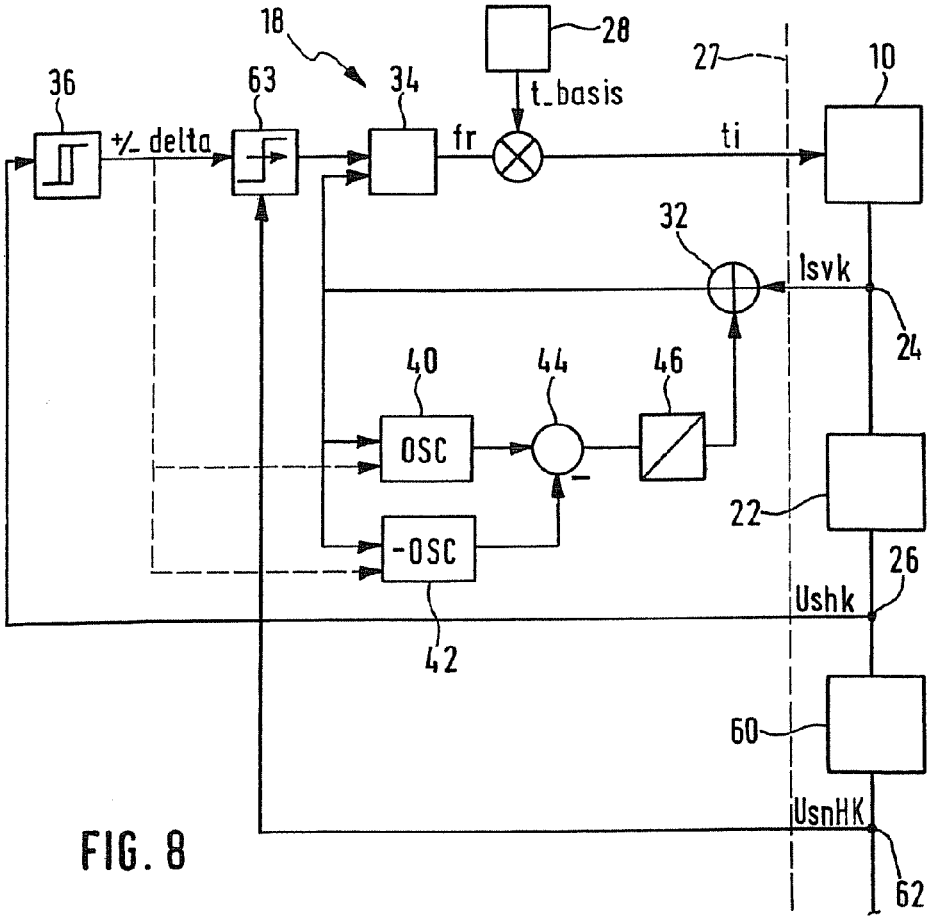
FIG. 8 is a corresponding schematic view of an exemplary embodiment of the present invention.
Figure 9:
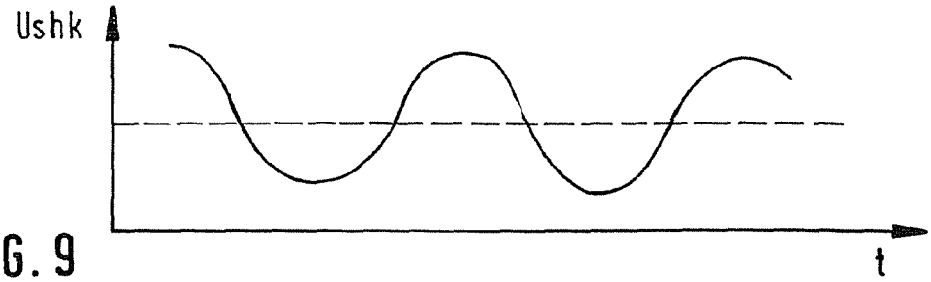
FIGS. 9 to 13 represent patterns over time of signals of the effect of the present invention within the framework of the technical environment.
Figure 10:
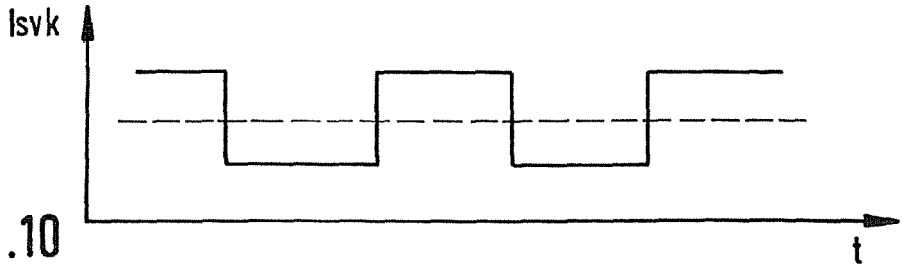
Figure 11:
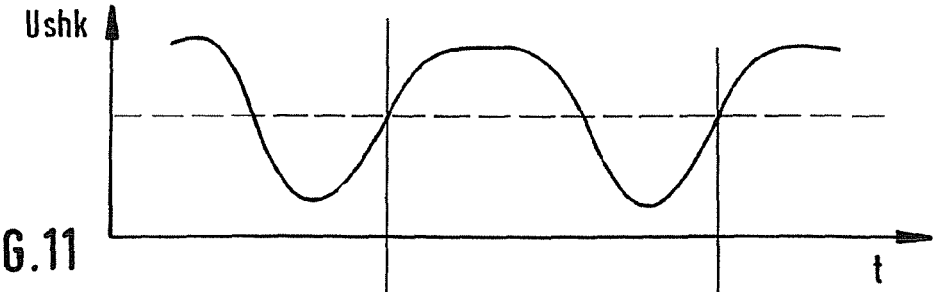
Figure 12:
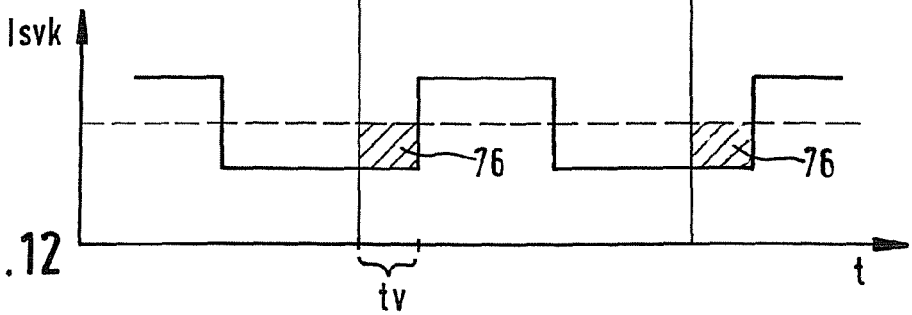
Figure 13:
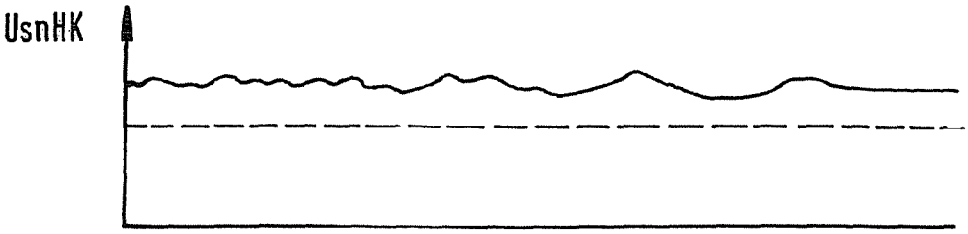

The structure of FIGS. 7 and 8 represents another exemplary embodiment. This exemplary embodiment differs from the subject matter of FIGS. 1 and 2 by having a main catalyst volume 60 downstream from Nernst probe 26 and by having a further Nernst probe 62 downstream from main catalyst volume 60. Main catalyst volume 60 has the function of compensating for the oscillation in the oxygen content of the exhaust gas downstream from partial catalyst volume 22, which of necessity occurs in this control concept. Since a slightly rich operation, on the average, may be desirable for an optimum catalytic converter operation, the structure described so far may be broadened by one more component which delivers this desirable enriching shift or, in other cases, possibly a desired enleaning shift. Within the framework of this preferred exemplary embodiment, this is accomplished by the additional Nernst probe 62. Its signal UsnHK (U probe downstream (from) main catalytic (converter)), acts upon a delay time member 63, which relays signal transitions in the output of two-step controller 36 to first controller 34. In that manner, the desired signal behavior illustrated in FIGS. 9 through 13 occurs. FIGS. 9 and 10 illustrate the already explained signals Ushk and Isvk in the steady state. FIG. 11 illustrates the pattern of signal Ushk within the framework of this exemplary embodiment. FIG. 12 illustrates that a change from lean to rich in signal Ushk is first relayed to controller 34 time-delayed by a delay time span tv, which occurs in the temporal pattern of the Isvk signal. Hatched areas 76 thus represent a desired additional MINUS OSC charge into the catalyst volumes, whereby, in the end, the signal of additional Nernst probe 62 illustrated in FIG. 13 occurs relatively uniformly in the rich range, running above 450 millivolt.

What is claimed is:

1. A method for regulating an air/fuel ratio of a combustion process which is operated cyclically and alternatingly with excess air and air deficiency, the method comprising:

providing at least one catalytic converter volume arrangement in an exhaust gas path of the combustion process, the volume arrangement having an oxygen reservoir to store exhaust gas oxygen in response to an excess of oxygen and to discharge the stored oxygen in response to an oxygen deficiency;

registering an oxygen breakthrough in response to a filled oxygen reservoir, and registering an oxygen deficiency in response to an emptied oxygen reservoir downstream from the catalytic converter by a Nernst lambda sensor;

summing the oxygen input into the oxygen reservoir of the catalytic converter volume arrangement in response to an excess of air;

summing the oxygen liberated by the oxygen reservoir of the catalytic converter volume arrangement in response to an air deficiency;

operating the combustion process in a cyclical sequence in each case, in which at least on average there is an excess of air and subsequently on average there is an air deficiency, until a Nernst lambda sensor situated downstream from the catalytic converter volume arrangement detects an oxygen breakthrough or the oxygen deficiency;

correcting, using a difference between the summed oxygen input and the summed liberated oxygen, a lambda control loop circuit, which includes a lambda sensor situated upstream of the catalytic converter volume arrangement;

using a variable to aid in determining a fuel inflow to the internal combustion engine for a determination of the oxygen charges into the catalyst volume during the air excess and the oxygen discharges from the catalyst volume during the air deficiency; and forming the variable as a function of a signal of an exhaust gas probe situated upstream from the catalytic converter;

wherein the variable includes an input variable for a second control loop, in which the fuel/air ratio is regulated using a time constant that is smaller in comparison than that in a first control loop.

2. The method according to claim 1, further comprising:

forming the variable based on an intake air quantity calculated from measured variables and based on a fuel quantity metered into the air intake quantity.

3. The method according to claim 2, further comprising:

changing a formation of the variable when the oxygen charges and the oxygen discharges deviate from each other.

4. The method according to claim 3, wherein the change occurs such that the deviation becomes smaller.

5. The method according to claim 1, further comprising:

changing a formation of the variable when the oxygen charges and the oxygen discharges deviate from each other.

6. The method according to claim 5, further comprising:

forming the change as a function of an integral of the deviation.

7. The method according to claim 1, further comprising:

predefining the fuel/air ratio by a superposed control loop.

8. The method according to claim 1, further comprising:

determining a real zero value between the oxygen excess and the oxygen deficiency based upon the values of the oxygen charges and oxygen discharges, as determined.

9. The method according to claim 1, further comprising:

determining a real zero value between the oxygen excess and the oxygen deficiency based upon the values of the oxygen charges and oxygen discharges, as determined.

10. A control device for regulating an air/fuel ratio of a combustion process which is operated cyclically and alternatingly with excess air and air deficiency, comprising:

at least one catalytic converter volume arrangement in an exhaust gas path of the combustion process, the volume arrangement having an oxygen reservoir to store exhaust gas oxygen in response to an excess of oxygen and to discharge the stored oxygen in response to an oxygen deficiency;

a registering arrangement to register an oxygen breakthrough in response to a filled oxygen reservoir and to register an oxygen deficiency in response to an emptied oxygen reservoir downstream from the catalytic converter by a Nernst lambda sensor;

a summing arrangement to sum the oxygen input into the oxygen reservoir of the catalytic converter volume arrangement in response to an excess of air, and to sum the oxygen liberated by the oxygen reservoir of the catalytic converter volume arrangement in response to an air deficiency;

a detecting arrangement to detect an oxygen breakthrough or the oxygen deficiency by operating the combustion process in a cyclical sequence in each case, in which at least on average there is an excess of air and subsequently on average there is an air deficiency, until a Nernst lambda sensor situated downstream from the catalytic converter volume arrangement detects the oxygen breakthrough or the oxygen deficiency; and a correcting arrangement to correct, using a difference between the summed oxygen input and the summed liberated oxygen, a lambda control loop circuit, which includes a lambda sensor situated upstream of the catalytic converter volume arrangement;

wherein:

a variable is used which at least co-determines a fuel inflow to the internal combustion engine for a determination of the oxygen charges into the catalyst volume during the air excess and the oxygen discharges from the catalyst volume during the air deficiency, the variable is formed as a function of a signal of an exhaust gas probe situated upstream from the catalytic converter, and the variable includes an input variable for a second control loop, in which the fuel/air ratio is regulated using a time constant that is smaller in comparison than that in a first control loop.

11. The control device according to claim 10, wherein a variable is formed based on an intake air quantity calculated from measured variables and based on a fuel quantity metered into the air intake quantity.

12. The control device according to claim 11, wherein a formation of the variable is changed when the oxygen charges and the oxygen discharges deviate from each other.

13. The control device according to claim 12, wherein the change occurs such that the deviation becomes smaller.

14. The control device according to claim 10, wherein a formation of the variable is changed when the oxygen charges and the oxygen discharges deviate from each other.

15. The control device according to claim 14, wherein the change is formed as a function of an integral of the deviation.

16. The control device according to claim 10, wherein the fuel/air ratio is predefined by a superposed control loop.

17. The control device according to claim 10, wherein a real zero value is determined between the oxygen excess and the oxygen deficiency based upon the values of the oxygen charges and oxygen discharges determined.

18. The control device according to claim 10, wherein a real zero value is determined between the oxygen excess and the oxygen deficiency based upon the values of the oxygen charges and oxygen discharges determined.

* * * * *